US010013836B2

(12) United States Patent
Finn

(10) Patent No.: US 10,013,836 B2
(45) Date of Patent: Jul. 3, 2018

(54) COIN CARD

(71) Applicant: Brian Finn, Ellensburg, WA (US)

(72) Inventor: Brian Finn, Ellensburg, WA (US)

(73) Assignee: COINCARD LLC, Ellensburg, WA (US)

( * ) Notice: Subject to any disclaimer, the term of this patent is extended or adjusted under 35 U.S.C. 154(b) by 0 days.

(21) Appl. No.: 15/647,019

(22) Filed: Jul. 11, 2017

(65) Prior Publication Data

US 2018/0012435 A1 Jan. 11, 2018

Related U.S. Application Data

(60) Provisional application No. 62/360,695, filed on Jul. 11, 2016.

(51) Int. Cl.

| | |
|---|---|
| ***G07D 9/00*** | (2006.01) |
| ***A45C 1/06*** | (2006.01) |
| ***A45C 13/00*** | (2006.01) |

(52) U.S. Cl.

CPC ..... *G07D 9/002* (2013.01); *A45C 1/06* (2013.01); *A45C 13/001* (2013.01); *A45C 13/005* (2013.01)

(58) Field of Classification Search

CPC .... G07D 9/002; A45C 2001/028; A45C 1/06; A45C 2001/102; A45C 2001/104

USPC ..... 206/0.8, 0.81, 84; 150/150, 136, 153, 150/151, 152

See application file for complete search history.

(56) References Cited

U.S. PATENT DOCUMENTS

| | | | | |
|---|---|---|---|---|
| 2,985,284 A * | 5/1961 | Levy | A47G 1/12 206/0.83 |
| 3,047,144 A * | 7/1962 | Wissel | B42D 15/045 206/0.83 |
| 3,592,204 A * | 7/1971 | Hernandez | A45C 1/02 206/0.84 |
| D252,775 S * | 8/1979 | Stoffel | D28/79 |
| 4,402,398 A | 7/1983 | Smoczynski | |
| 4,836,365 A * | 6/1989 | Hall | G07D 1/08 206/0.8 |

(Continued)

OTHER PUBLICATIONS

3D Design, 3D Printing, Michelle Matisons, "Tired of Loose Change in Your Pockets? 3D Print a Wallet-Sized Coin Holder!" Jan. 5, 2016. https://3dprint.com/113686/3d-printed-coin-holder/.

*Primary Examiner* — Steven A. Reynolds

(74) *Attorney, Agent, or Firm* — Ruttler Mills, PLLC; James J. Ruttler

(57) ABSTRACT

A device for holding coins, the device comprising a rectangular structure including: a first level including: eleven apertures including: four penny size apertures, four dime size apertures, a nickel size aperture, and two quarter size apertures arranged clockwise around the first level in the order of, from a top left corner: dime, nickel, dime, penny, quarter, dime, dime, quarter, and penny, with the third penny located between the first dime and fourth dime and the fourth penny located between the second dime and third dime; and a second level including: two apertures, surrounded by the apertures of the first level including: a penny located between the first and fourth dime and a penny located between the second and third dime; and a flange that partially overlaps one or more of the apertures of the first level and forms at least part of the fifth and sixth penny size apertures.

15 Claims, 7 Drawing Sheets

(56) References Cited

U.S. PATENT DOCUMENTS

| | | | | |
|---|---|---|---|---|
| 5,026,321 | A | 6/1991 | Benson | |
| 5,492,504 | A | 2/1996 | Wolters | |
| 5,499,710 | A * | 3/1996 | Hoffman | A45C 1/02 206/0.81 |
| 6,202,835 | B1 * | 3/2001 | Morse | A45C 1/02 206/0.84 |
| 6,302,777 | B1 | 10/2001 | Zoldan | |
| 6,318,547 | B1 * | 11/2001 | Pianezzola | G07D 9/002 206/0.81 |
| 7,083,512 | B2 * | 8/2006 | Auguste, Jr. | A45C 1/02 150/136 |
| 7,418,987 | B2 * | 9/2008 | Duffy | A45C 1/06 150/136 |
| 9,805,535 | B2 * | 10/2017 | Johnson | G07D 9/002 |
| 2002/0195354 | A1 * | 12/2002 | Davis, Jr. | A45C 1/10 206/0.84 |
| 2004/0245122 | A1 * | 12/2004 | Newenham | A45C 1/10 206/0.8 |

* cited by examiner

COIN CARD

PRIORITY CLAIM

This application claims the benefit of and/or is a non-provisional of U.S. Provisional Patent Application 62/360,695 filed Jul. 11, 2016. The foregoing application is incorporated by reference in its entirety as if fully set forth herein.

FIELD OF THE INVENTION

This invention relates generally to consumer product and, more specifically, to a coin holding device.

SUMMARY

In one embodiment, a card for securing and carrying coins is provided. Specifically, the card is shaped to dimensions to fit within a standard wallet pocket typically used for credit cards, identification cards, membership cards, and the like. The card is formed from metal, plastic, wood, composite, or other similar material and has dimensions of approximately 85.6 mm by 56 mm by 4.5 mm. On a first level is provided spaces sized to receive and secure therein: four pennies, four dimes, one nickel, and two quarters. The card by its unique arrangement is configured to carry up to 99 cents of coin change, but every total of coins between 1 and 99 cents can be carried. The first level functions as a floor for coins and includes, starting from the bottom right and moving in a clockwise direction then spiraling inward, the following coin apertures: quarter (24.5 mm diameter), dime (17.91 mm diameter), dime (17.1 mm diameter), quarter (24.5 mm diameter), penny (19.1 mm diameter), dime (17.91 mm diameter), nickel (21.25 mm diameter), dime (17.91 mm diameter), and penny (19.1 mm diameter); followed by two pennies (19.1 mm diameter) in the center of the level, but the aperture diameters can vary from 10 mm to 50 mm. The arrangement and the diameters of each coin aperture maximize the storage capacity of the card while securely retaining any coins disposed therein. The second level provides a lip or flange to partially cover coins secured on the first level to decrease unintentional release of coins. The lip or flange can have various dimensions, but some possible ones include: 60 mm radius over quarter apertures, 34 mm radius over penny apertures, 36 mm radius over dime apertures, and 48 mm radius over nickel apertures. Additional finger gaps are provided in the perimeter of the card to aid in release of coins in the first level, the gaps having dimensions as follows: 17.91 mm radius for dimes, 24.5 mm radius for quarters, 19.1 mm radius for pennies, and 21.25 mm radius for nickels. The finger gaps may vary in size from 10 mm to 50 mm depending on alternative varieties of coins being stored in the apertures.

In various alternative embodiments, fewer or greater levels may be present such as only one or three levels for coins. In other embodiments, fewer or greater coin apertures may be present to secure different amounts of coins. In yet further embodiments, any of the dimensions may be modified to facilitate retaining or release of coins. In additional embodiments, a pocket or clip may be attached to the card to secure paper money. Alternatively, one of the coin apertures may be sized to secure one or more future embodiments of currency. Furthermore, the card can include memory, processor, display, transmitter components to facilitate electronic payments (e.g., may store credit card, merchant card, bitcoin information). In certain embodiments, the card can include a strap or a flange to secure to a back of a smartphone.

The particulars shown herein are by way of example. In this regard, no attempt is made to show structural details of the invention in more detail than is necessary for the fundamental understanding of the invention. The description taken with the drawings and/or examples make apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Specific elements of any foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

While preferred and alternate embodiments have been illustrated and described, as noted above, many changes can be made without departing from the spirit and scope of the disclosure. Accordingly, the inventive concept is not limited by the disclosure of these preferred and alternate embodiments.

BRIEF DESCRIPTION OF THE DRAWINGS

Embodiments of the present invention are described in detail below with reference to the following drawings.

DETAILED DESCRIPTION

This invention relates generally to a consumer product and, more specifically, to a coin card. Specific details of certain embodiments of the invention are set forth in the following description and in FIGS. 1-7 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
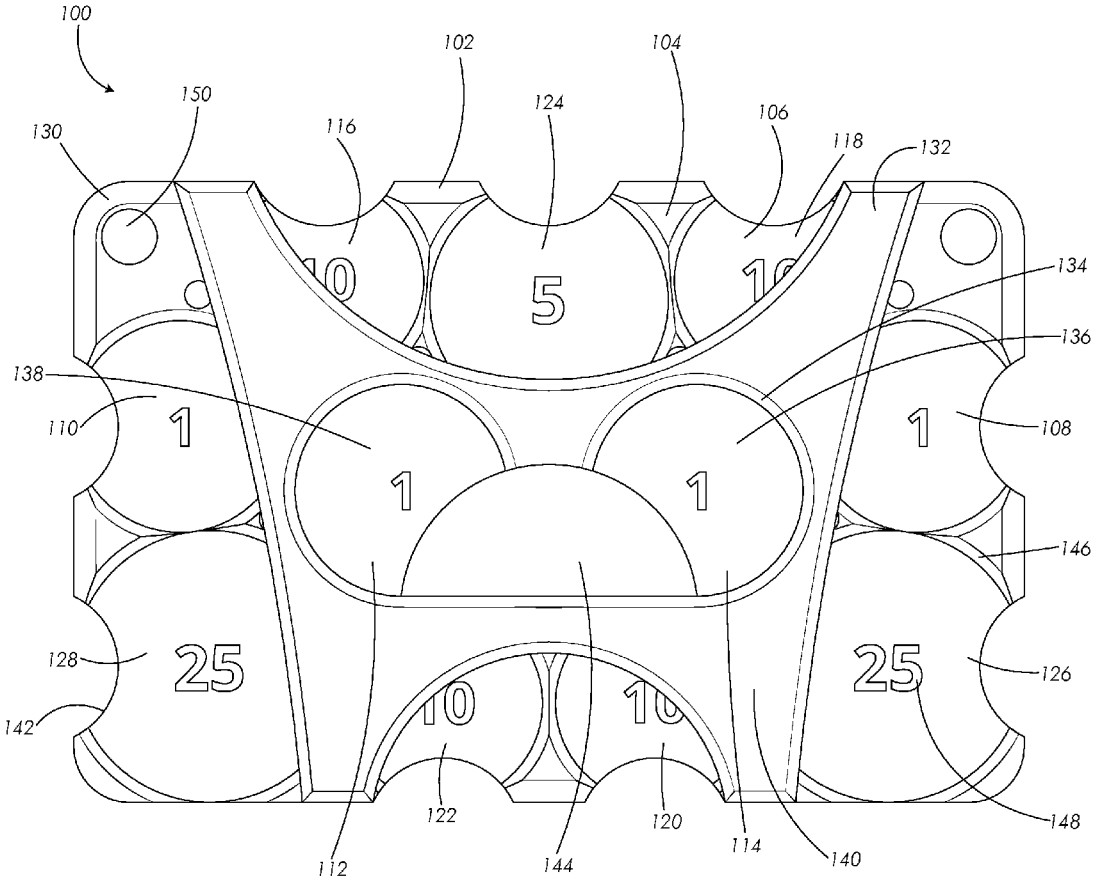
FIG. 1 is a top perspective of a coin card, in accordance with an embodiment of the invention.

FIG. 1 is a top perspective of a coin card, in accordance with an embodiment of the invention.

In one embodiment, the coin card device 100 includes, but is not limited to a rectangular structure 102 which includes a first level 104, the first level 104 capable of acting as a floor to carried coins and including eleven apertures 106, the eleven apertures 106 including: a first penny size aperture 108, a second penny size aperture 110, a third penny size aperture 112, a fourth penny size aperture 114, a first dime size aperture 116, a second dime size aperture 118, a third dime size aperture 120, a fourth dime size aperture 122, a first nickel size aperture 124, a first quarter size aperture 126, and a second quarter size aperture 128 arranged clockwise around the first level 104 in the order of, from a top left corner of the first level 130: the first dime size aperture 116, the first nickel size aperture 124, the second dime size aperture 118, the first penny size aperture 108, the first quarter size aperture 126, the third dime size aperture 120, the fourth dime size aperture 122, the second quarter size aperture 128, and the second penny size aperture 110. The third penny size aperture 112 is located between the first dime size aperture 116 and fourth dime size aperture 122 and the fourth penny size aperture 114 located between the second dime size aperture 118 and third dime size aperture 120.

The device further includes a second level 132, the second level 132 including two apertures 134 surrounded by the eleven apertures 106 of the first level 104 including: a fifth penny size aperture 136 located between the first dime size aperture 116 and fourth dime size aperture 122 and a sixth penny size aperture 138 located between the second dime size aperture 118 and third dime size aperture 120 wherein the third penny size aperture 132 partially overlaps the fourth dime size aperture 118 and the fourth penny size aperture 134 partially overlaps the third dime size aperture 116; and a flange 140 that partially overlaps one or more of the eleven apertures of the first level 106 and forms at least part of the fifth penny size aperture 136 and the sixth penny size aperture 138.

In at least one embodiment the rectangular structure 102 is defined by a rectangular shape with dimensions of approximately 85.6 mm by 56 mm by 4.5 mm. In other embodiments, the width can vary from 50 mm to 100 mm, the height can vary from 30 mm to 70 mm and the thickness can vary from 2 mm to 8 mm. In other embodiments, the rectangular structure 102 can be defined by polygonal shapes from at least one of the following types of shapes: square, rectangle, circle, semi-circle, polygonal, or trapezoidal.

The coin card device 100 may be constructed of a variety of substances and materials, including but not limited to: metal, plastic, wood, composite glass, or ceramic, or may be comprised of some combination thereof. The coin card device 100 does not need to be entirely made of the same material. For example, but not limited to, the first level 106 could be comprised of a plastic material, whole the second level could be made of a metal. In some embodiments, the individual components may mix materials, such as, but not limited to, the first level 106 being comprised of metal with the corners made of rubber, while the second level could be made of plastic with metal rims around the apertures.

In some embodiments, the apertures of the first level 106 and second level 132 are defined by a circular shape. In other embodiments, the apertures are defined by polygonal shapes including, but not limited to: square, rectangle, circle, semi-circle, polygonal, or trapezoidal.

In some embodiments, the apertures of the first level 106 and second level 132 are defined by the following diameters: the first penny size aperture 108 is 19.1 mm in diameter, the second penny size aperture 110 is 19.1 mm in diameter, the third penny size aperture 112 is 19.1 mm in diameter, the fourth penny size 114 aperture is 19.1 mm in diameter, the fifth penny size aperture 136 is 19.1 mm in diameter, the sixth penny size aperture 138 is 19.1 mm in diameter, the first dime size aperture 116 is 17.91 mm in diameter, the second dime size aperture 118 is 17.91 mm in diameter, the third dime size aperture 120 is 17.91 mm in diameter, the fourth dime size aperture 122 is 17.91 mm in diameter, the first quarter size aperture is 24.5 mm in diameter, the second quarter size aperture is 24.5 mm in diameter, and the first nickel size aperture is 21.25 mm in diameter. However, the apertures can vary from approximately 10 mm to 50 mm in radius for alternative varieties of coin. The depth of the apertures can also vary depending on the size of the intended coins, varying from 1.5 mm to 6 mm.

In some embodiments, a coin holder device includes finger gaps 140 that may be located around the perimeter of the rectangular structure 102 for facilitating insertion and removal of the coins from the apertures of the first level 106 and second level 132. The finger gaps 136 may be defined by polygonal shapes from at least one of the following types of shapes: square, rectangle, circle, semi-circle, polygonal, or trapezoidal. In some embodiments, the finger gaps may also be located going through the second level 128 in order to facilitate access to the third penny size aperture 132 and fourth penny size aperture 134. In some embodiments, there may be finger gaps in the form of channels 142 located inside of the rectangular structure 102 for facilitating removing coins from the eleven apertures 106. In some embodiments, the coin card includes other mechanisms to facilitate the removal of coins that may be independent of or in addition to the finger gaps, including but not limited to: movable flaps, spring loaded buttons, hinged clasp, sliding section, cinch squeezes, adhesives, friction squeezes, latches, or other locking mechanisms.

In some embodiments, the flange of the second level 140 may include an internal aperture 144 that partially forms a finger gap, or it may form part or all of the fifth penny size aperture 136 and the sixth penny size aperture 138. The internal aperture 144 may be of a variety of shapes including circles, polygons, lemniscates, figure-eight or other irregular shapes. The internal aperture 144 can range in radius from 10 mm to 120 mm depending on the coins associated with it. The internal aperture 144 can have a depth of 1 mm to as thick as 20 mm.

In some embodiments, the apertures of the first level 106 and second level 132 may have a lip or flange 146 partially covering the apertures in order to more securely hold coins or other round objects placed inside the apertures. In some embodiments, the lip or flange 146 may be a movable flap, cinch squeeze, or other securing mechanism. The flange 146 may cover multiple apertures.

In some embodiments, the second level 132 may be attached to the first level 104 by a mechanism, including but not limited to a latch, hinge, snap, slide, spring, or other locking mechanism. In some embodiments, the second level 132 is partially or fully removable from the first level 104. In some embodiments, the second level 132 can swing up or down on a hinge or other movable attachment attached to the first level 104. The attachment point can be located anywhere along the first level 104 or second level 132.

In some embodiments, the coin card device 100 has a second flange attached to the rectangular structure 100. This flange may be curved inward on itself in order to be able to store paper money or other objects such as credit cards. The second flange may be partially or fully removable and may be attached by a latch, hinge, snap, spring, or other locking mechanism. The second flange may be made of the same or a different material, or combination of materials, to the rectangular structure 100. The second flange may be used to secure the coin card device 100 to a pocket or wallet. The second flange may be in the form of a clip or other shape as needed to secure contents or to secure the coin card device 100 to another object. The flap can be as large as the coin card device 100 itself or be smaller, and may be bent or otherwise distorted to provide improved grip on objects. In other embodiments, the width can vary from 50 mm to 100 mm, the height can vary from 30 mm to 70 mm and the thickness can vary from 2 mm to 8 mm.

In some embodiments, the coin card device 100 includes circuitry configured for the storing, receiving, or transmitting transactional and financial data through incorporated computer hardware and antennae. In some further embodiments, the coin card device 100 may additionally include a display configured to display the stored or received transactional or financial data. This display can be anywhere from 3 mm by 3 mm to 30 mm by 30 mm in size. The coin card device 100 may also include buttons or other inputs capable of allowing the user to trigger the storage or transmission of financial and transactional data, or allow them to manipulate stored or received data.

In some embodiments, the coin card device 100 includes springs or other devices located between the eleven apertures 106 that exert an outward pressure on any objects stored inside the apertures 106 in order to facilitate the removal of said object. In embodiments where finger gaps 140 are present these springs or other devices may be positioned such that the exert a force towards the finger gap for further ease of removal of any objects stored within.

In some embodiments, the coin card device 100 includes numbers 148 located inside the eleven apertures 106. These numbers 148 may be recessed indentations that form the digits corresponding to the size of the eleven apertures 106. The numbers 148 may alternatively be printed using a contrasting ink, or embedded with a different colored material from the rectangular structure 102. The numbers 148 may instead be embossed or printed images of the coins meant to fit in the eleven apertures 106. The numbers can be as small as 1 mm by 1 mm or as large as 50 mm by 50 mm.

The coin card device 100 may have one or more channels 150 through it to allow for it to be secured to another device through a cord or other locking mechanism passed through the channel. In some embodiments, the one or more channels 150 are used as part of the connection between the first level 104 and second level 132. The channels 150 can be as small as 1 mm in radius up to 50 mm in radius.

Figure 2:
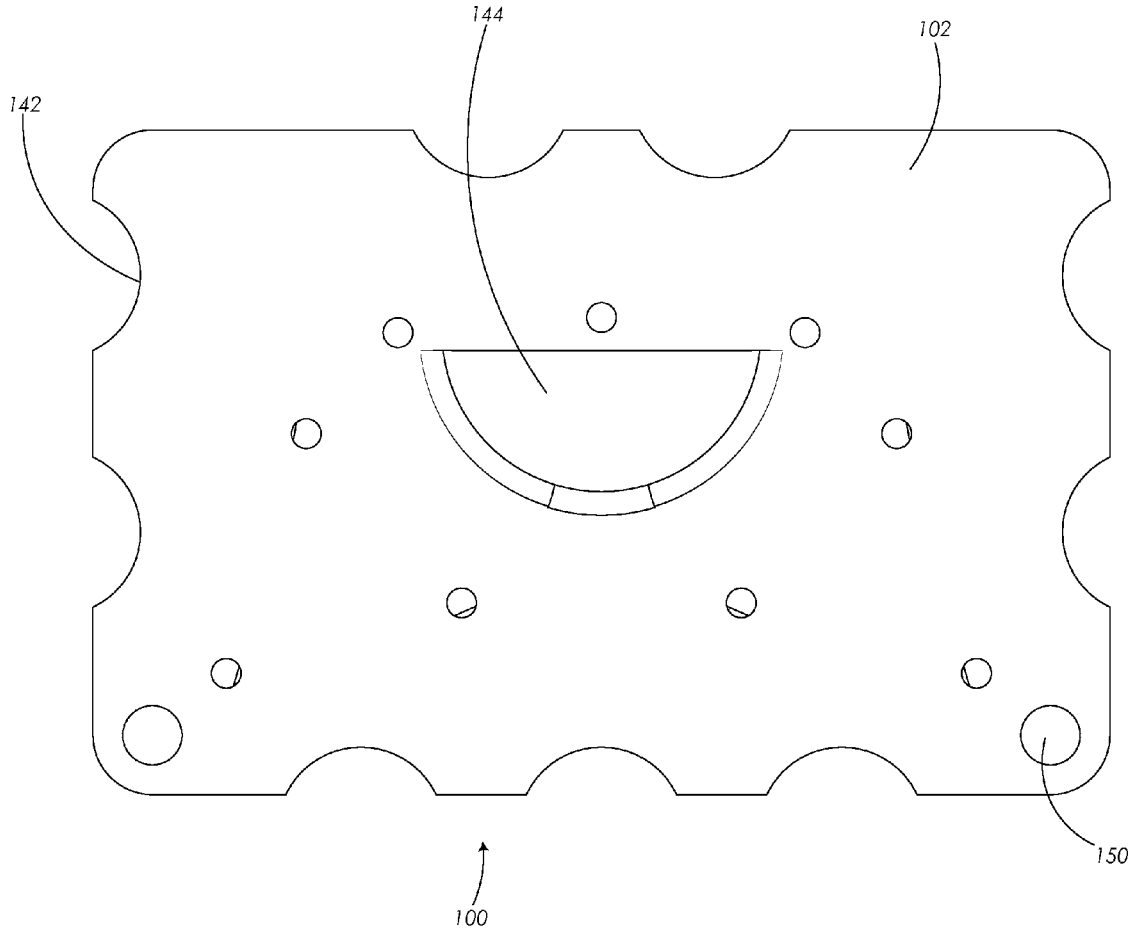
FIG. 2 is a bottom perspective of a coin card, in accordance with an embodiment of the invention.

FIG. 2 is a bottom perspective of a coin card, in accordance with an embodiment of the invention.

In one embodiment, the coin card device 100 includes, but is not limited to a rectangular structure 102. In some embodiments, the coin card device 100 has a third level which may be attached on top of the second level 132 or on the opposite side of the first level 104 as the second level 132. The third level may contain additional apertures or flanges for carrying coins or other objects. The third level can vary in size, or be the same size as the first level 104; the width can vary from 50 mm to 100 mm, the height can vary from 30 mm to 70 mm and the thickness can vary from 2 mm to 8 mm. The third level may be made of the same composition as the first level 104 or of a different material or combination of materials.

Figure 3:
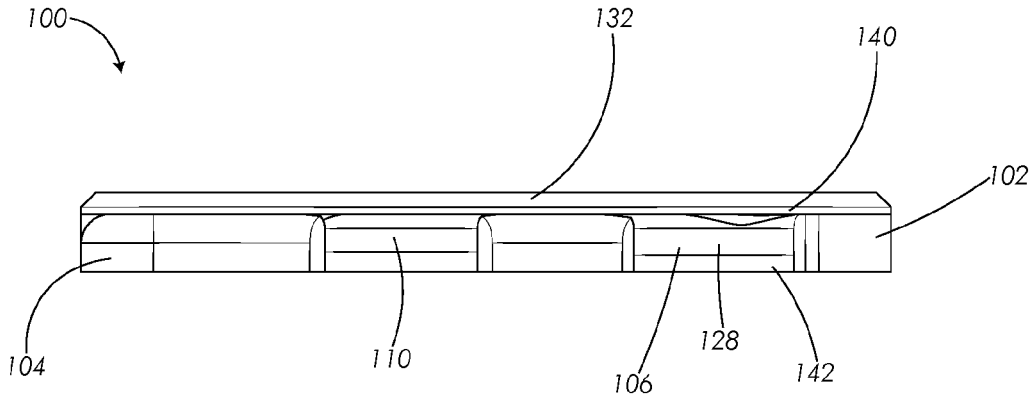
FIG. 3 is a left-side perspective of a coin card, in accordance with an embodiment of the invention.

FIG. 3 is a left-side perspective of a coin card, in accordance with an embodiment of the invention.

In one embodiment, the coin card device 100 includes, but is not limited to a rectangular structure 102 which includes a first level 104, the first level 104 capable of acting as a floor for any carried coins and including eleven apertures 106, the eleven apertures including: a first penny size aperture 108, a second penny size aperture 110, a third penny size aperture 112, a fourth penny size aperture 114, a first dime size aperture 116, a second dime size aperture 118, a third dime size aperture 120, a fourth dime size aperture 122, a first nickel size aperture 124, a first quarter size aperture 126, and a second quarter size aperture 128 arranged clockwise around the first level 104 in the order of, from a top left corner of the first level 130: the first dime size aperture 116, the first nickel size aperture 124, the second dime size aperture 118, the first penny size aperture 108, the first quarter size aperture 126, the third dime size aperture 120, the fourth dime size aperture 122, the second quarter size aperture 128, and the second penny size aperture 110. The third penny size aperture 112 is located between the first dime size aperture 116 and fourth dime size aperture 122 and the fourth penny size aperture 114 located between the second dime size aperture 118 and third dime size aperture 120.

The device further includes a second level 132, the second level 132 including two apertures 134 surrounded by the eleven apertures 106 of the first level 104 including: a fifth penny size aperture 136 located between the first dime size aperture 116 and fourth dime size aperture 122 and a sixth penny size aperture 138 located between the second dime size aperture 118 and third dime size aperture 120 wherein the third penny size aperture 132 partially overlaps the fourth dime size aperture 118 and the fourth penny size aperture 134 partially overlaps the third dime size aperture 116; and a flange 140 that partially overlaps one or more of the eleven apertures of the first level 106 and forms at least part of the fifth penny size aperture 136 and the sixth penny size aperture 138.

Figure 4:
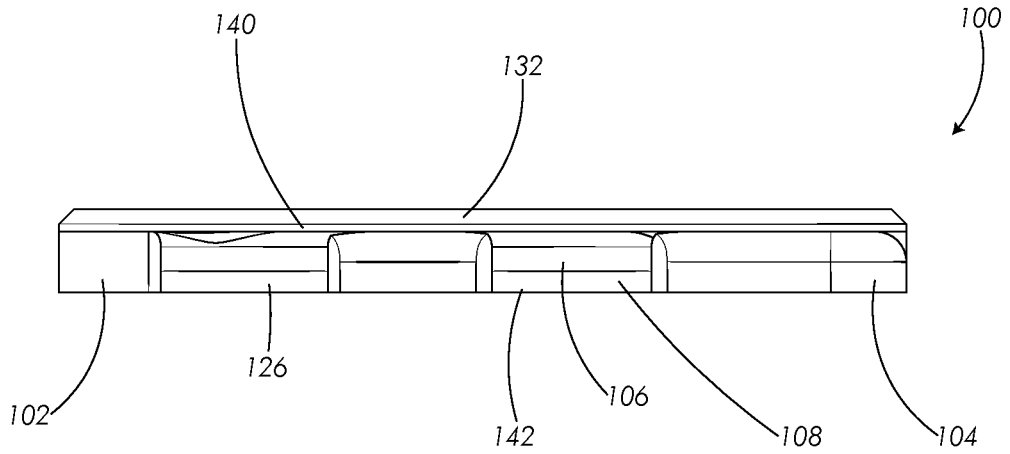
FIG. 4 is a right-side perspective of a coin card, in accordance with an embodiment of the invention.

FIG. 4 is a right-side perspective of a coin card, in accordance with an embodiment of the invention.

In one embodiment, the coin card device 100 includes, but is not limited to a rectangular structure 102 which includes a first level 104, the first level 104 capable of acting as a floor for any carried coins and including eleven apertures 106, the eleven apertures including: a first penny size aperture 108, a second penny size aperture 110, a third penny size aperture 112, a fourth penny size aperture 114, a first dime size aperture 116, a second dime size aperture 118, a third dime size aperture 120, a fourth dime size aperture 122, a first nickel size aperture 124, a first quarter size aperture 126, and a second quarter size aperture 128 arranged clockwise around the first level 104 in the order of, from a top left corner of the first level 130: the first dime size aperture 116, the first nickel size aperture 124, the second dime size aperture 118, the first penny size aperture 108, the first quarter size aperture 126, the third dime size aperture 120, the fourth dime size aperture 122, the second quarter size aperture 128, and the second penny size aperture 110. The third penny size aperture 112 is located between the first dime size aperture 116 and fourth dime size aperture 122 and the fourth penny size aperture 114 located between the second dime size aperture 118 and third dime size aperture 120.

The device further includes a second level 132, the second level 132 including two apertures 134 surrounded by the eleven apertures 106 of the first level 104 including: a fifth penny size aperture 136 located between the first dime size aperture 116 and fourth dime size aperture 122 and a sixth penny size aperture 138 located between the second dime size aperture 118 and third dime size aperture 120 wherein the third penny size aperture 132 partially overlaps the fourth dime size aperture 118 and the fourth penny size aperture 134 partially overlaps the third dime size aperture 116; and a flange 140 that partially overlaps one or more of the eleven apertures of the first level 106 and forms at least part of the fifth penny size aperture 136 and the sixth penny size aperture 138.

Figure 5:
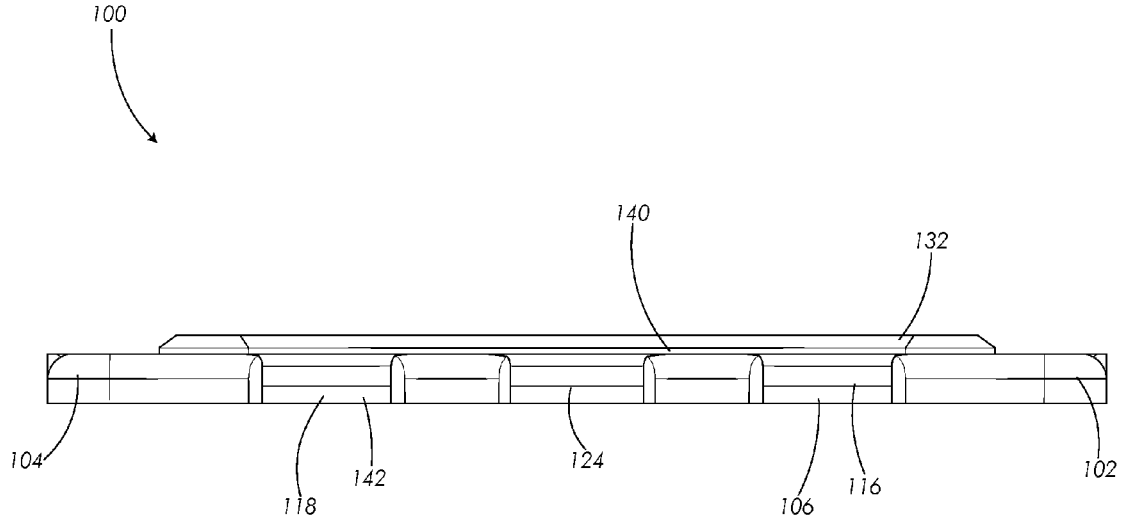
FIG. 5 is a top perspective of a coin card, in accordance with an embodiment of the invention.

FIG. 5 is a top perspective of a coin card, in accordance with an embodiment of the invention.

In one embodiment, the coin card device 100 includes, but is not limited to a rectangular structure 102 which includes a first level 104, the first level 104 capable of acting as a floor for any carried coins and including eleven apertures 106, the eleven apertures including: a first penny size aperture 108, a second penny size aperture 110, a third penny size aperture 112, a fourth penny size aperture 114, a first dime size aperture 116, a second dime size aperture 118, a third dime size aperture 120, a fourth dime size aperture 122, a first nickel size aperture 124, a first quarter size aperture 126, and a second quarter size aperture 128 arranged clockwise around the first level 104 in the order of, from a top left corner of the first level 130: the first dime size aperture 116, the first nickel size aperture 124, the second dime size aperture 118, the first penny size aperture 108, the first quarter size aperture 126, the third dime size aperture 120, the fourth dime size aperture 122, the second quarter size aperture 128, and the second penny size aperture 110. The third penny size aperture 112 is located between the first dime size aperture 116 and fourth dime size aperture 122 and the fourth penny size aperture 114 located between the second dime size aperture 118 and third dime size aperture 120.

The device further includes a second level 132, the second level 132 including two apertures 134 surrounded by the eleven apertures 106 of the first level 104 including: a fifth penny size aperture 136 located between the first dime size aperture 116 and fourth dime size aperture 122 and a sixth penny size aperture 138 located between the second dime size aperture 118 and third dime size aperture 120 wherein the third penny size aperture 132 partially overlaps the fourth dime size aperture 118 and the fourth penny size aperture 134 partially overlaps the third dime size aperture 116; and a flange 140 that partially overlaps one or more of the eleven apertures of the first level 106 and forms at least part of the fifth penny size aperture 136 and the sixth penny size aperture 138.

Figure 6:
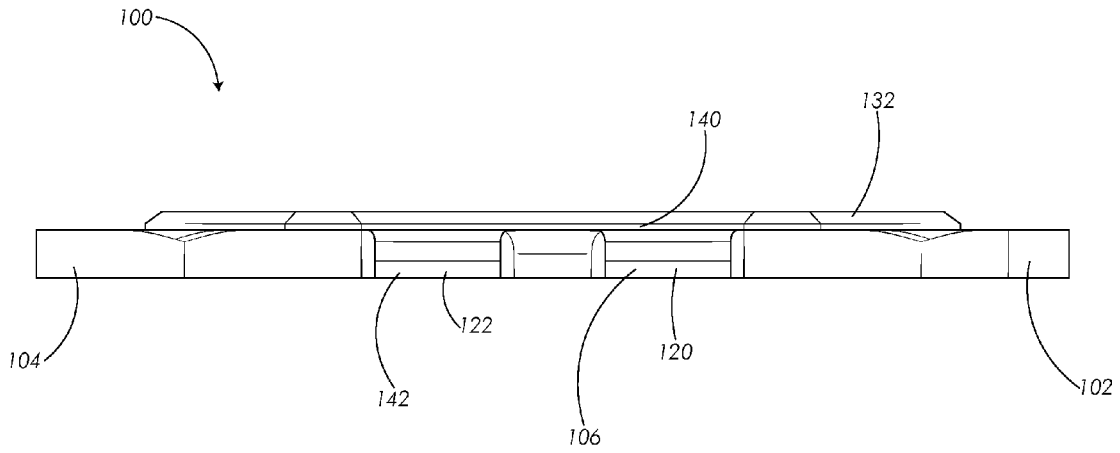
FIG. 6 is a bottom perspective of a coin card, in accordance with an embodiment of the invention.

FIG. 6 is a bottom perspective of a coin card, in accordance with an embodiment of the invention.

In one embodiment, the coin card device 100 includes, but is not limited to a rectangular structure 102 which includes a first level 104, the first level 104 capable of acting as a floor for any carried coins and including eleven apertures 106, the eleven apertures including: a first penny size aperture 108, a second penny size aperture 110, a third penny size aperture 112, a fourth penny size aperture 114, a first dime size aperture 116, a second dime size aperture 118, a third dime size aperture 120, a fourth dime size aperture 122, a first nickel size aperture 124, a first quarter size aperture 126, and a second quarter size aperture 128 arranged clockwise around the first level 104 in the order of, from a top left corner of the first level 130: the first dime size aperture 116, the first nickel size aperture 124, the second dime size aperture 118, the first penny size aperture 108, the first quarter size aperture 126, the third dime size aperture 120, the fourth dime size aperture 122, the second quarter size aperture 128, and the second penny size aperture 110. The third penny size aperture 112 is located between the first dime size aperture 116 and fourth dime size aperture 122 and the fourth penny size aperture 114 located between the second dime size aperture 118 and third dime size aperture 120.

The device further includes a second level 132, the second level 132 including two apertures 134 surrounded by the eleven apertures 106 of the first level 104 including: a fifth penny size aperture 136 located between the first dime size aperture 116 and fourth dime size aperture 122 and a sixth penny size aperture 138 located between the second dime size aperture 118 and third dime size aperture 120 wherein the third penny size aperture 132 partially overlaps the fourth dime size aperture 118 and the fourth penny size aperture 134 partially overlaps the third dime size aperture 116; and a flange 140 that partially overlaps one or more of the eleven apertures of the first level 106 and forms at least part of the fifth penny size aperture 136 and the sixth penny size aperture 138.

Figure 7:
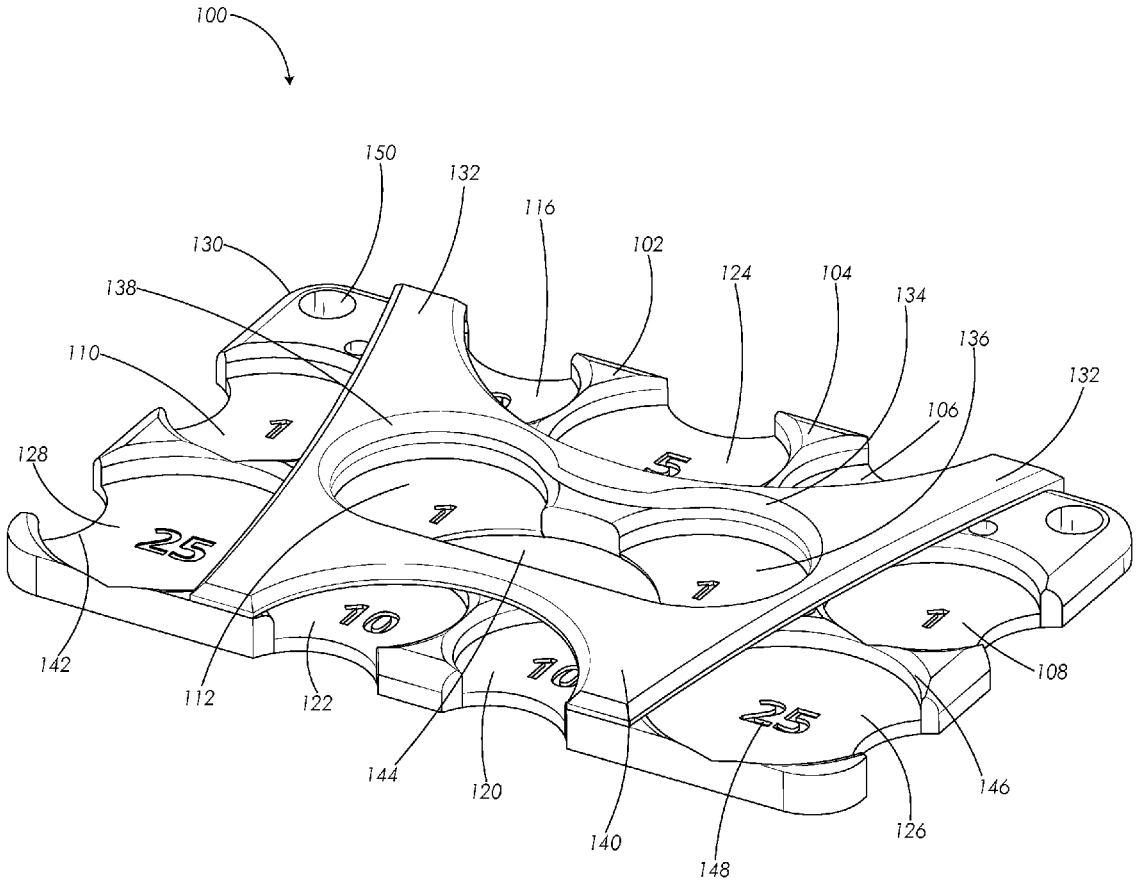
FIG. 7 is an isometric perspective of a coin card, in accordance with an embodiment of the invention.

FIG. 7 is an isometric perspective of a coin card, in accordance with an embodiment of the invention.

In one embodiment, the coin card device 100 includes, but is not limited to a rectangular structure 102 which includes a first level 104, the first level 104 capable of acting as a floor for any carried coins and including eleven apertures 106, the eleven apertures including: a first penny size aperture 108, a second penny size aperture 110, a third penny size aperture 112, a fourth penny size aperture 114, a first dime size aperture 116, a second dime size aperture 118, a third dime size aperture 120, a fourth dime size aperture 122, a first nickel size aperture 124, a first quarter size aperture 126, and a second quarter size aperture 128 arranged clockwise around the first level 104 in the order of, from a top left corner of the first level 130: the first dime size aperture 116, the first nickel size aperture 124, the second dime size aperture 118, the first penny size aperture 108, the first quarter size aperture 126, the third dime size aperture 120, the fourth dime size aperture 122, the second quarter size aperture 128, and the second penny size aperture 110. The third penny size aperture 112 is located between the first dime size aperture 116 and fourth dime size aperture 122 and the fourth penny size aperture 114 located between the second dime size aperture 118 and third dime size aperture 120.

The device further includes a second level 132, the second level 132 including two apertures 134 surrounded by the eleven apertures 106 of the first level 104 including: a fifth penny size aperture 136 located between the first dime size aperture 116 and fourth dime size aperture 122 and a sixth penny size aperture 138 located between the second dime size aperture 118 and third dime size aperture 120 wherein the third penny size aperture 132 partially overlaps the fourth dime size aperture 118 and the fourth penny size aperture 134 partially overlaps the third dime size aperture 116; and a flange 140 that partially overlaps one or more of the eleven apertures of the first level 106 and forms at least part of the fifth penny size aperture 136 and the sixth penny size aperture 138.

What is claimed is:

1. A device for holding coins, the device comprising:
a rectangular structure including:
a first level, the first level including:
eleven apertures including:
a first penny size aperture, a second penny size aperture, a third penny size aperture, a fourth penny size aperture, a first dime size aperture, a second dime size aperture, a third dime size aperture, a fourth dime size aperture, a first nickel size aperture, a first quarter size aperture, and a second quarter size aperture arranged clockwise and then inward around the first level, from a top left corner of the first level:
the first dime size aperture, the first nickel size aperture, the second dime size aperture, the first penny size aperture, the first quarter size aperture, the third dime size aperture, the fourth dime size aperture, the second quarter size aperture, and the second penny size aperture, with the third penny size aperture located between the first dime size aperture and fourth dime size aperture and the fourth penny size aperture located between the second dime size aperture and third dime size aperture; and
a second level, the second level including:
two apertures, surrounded by the eleven apertures of the first level including:
a fifth penny size aperture located between the first dime size aperture and fourth dime size aperture and a sixth penny size aperture located between the second dime size aperture and third dime size aperture; and
a flange that partially overlaps one or more of the eleven apertures of the first level and forms at least part of the fifth penny size aperture and the sixth penny size aperture.

2. The device of claim 1, wherein:
the first penny size aperture is 19.1 mm in diameter,
the second penny size aperture is 19.1 mm in diameter,
the third penny size aperture is 19.1 mm in diameter,
the fourth penny size aperture is 19.1 mm in diameter,
the first dime size aperture is 17.91 mm in diameter,
the second dime size aperture is 17.91 mm in diameter,
the first quarter size aperture is 24.5 mm in diameter,
the second quarter size aperture is 24.5 mm in diameter, and
the first nickel size aperture is 21.25 mm in diameter.

3. The device of claim 1, further comprising one or more finger gaps.

4. The device of claim 3, wherein the one or more finger gaps are located around the perimeter of the first level.

5. The device of claim 4, wherein the one or more finger gaps are located between the edge of the rectangular structure and one or more centers of the first dime size aperture, the first nickel size aperture, the second dime size aperture, the first penny size aperture, the first quarter size aperture, the third dime size aperture, the fourth dime size aperture, the second quarter size aperture, and the second penny size aperture.

6. The device of claim 3, wherein the one or more finger gaps are a channel through the center of the device between the fifth penny size aperture and the sixth penny size aperture.

7. The device of claim 3, wherein the one or more finger gaps are defined by at least one of the following types of shapes: semi-circle, square, rectangle, triangle, rhombus, ellipse, pentagon, hexagon, heptagon, octagon, nonagon, decagon.

8. The device of claim 7, wherein the one or more finger gaps have a maximum radius of 17.91 mm for the first dime size aperture, second dime size aperture, third dime size aperture, and fourth dime size aperture; 19.1 mm for the first penny size aperture, second penny size aperture, third penny size aperture, and fourth penny size aperture; 21.25 mm for the first nickel size aperture; and 24.5 mm for the first quarter size aperture and second quarter size aperture.

9. The device of claim 1, wherein the flange includes an internal aperture in the shape of a lemniscate that forms the fifth penny size aperture and the sixth penny size aperture.

10. The device of claim 1, wherein the rectangular structure is 85.6 mm wide, 56 mm tall, and 4.5 mm thick.

11. The device of claim 1, wherein the second level is removably attached to the first level.

12. The device of claim 1, wherein the device includes an attachment flange located on the opposite side of the device from the flange of the second level.

13. The device of claim 1, wherein the rectangular structure is comprised of a substance from at least one of the following: metal, plastic, wood, composite glass, or ceramic.

14. A device for holding coins, the device comprising:
a rectangular structure including:
a first level, the first level including:
eleven apertures including:
a first penny size aperture, a second penny size aperture, a third penny size aperture, a fourth penny size aperture, a first dime size aperture, a second dime size aperture, a third dime size aperture, a fourth dime size aperture, a first nickel size aperture, a first quarter size aperture, and a second quarter size aperture arranged clockwise and then inward around the first level in the order of, from a top left corner of the first level:
the first dime size aperture, the first nickel size aperture, the second dime size aperture, the first penny size aperture, the first quarter size aperture, the third dime size aperture, the fourth dime size aperture, the second quarter size aperture, and the second penny size aperture, with the third penny size aperture located between the first dime size aperture and fourth dime size aperture and the fourth penny size aperture located between the second dime size aperture and third dime size aperture; and
a second level, removably attached to the first level, the second level including:
two apertures, surrounded by the eleven apertures of the first level including:
a fifth penny size aperture located between the first dime size aperture and fourth dime size aperture and a sixth penny size aperture located between the second dime size aperture and third dime size aperture; and
a flange that partially overlaps one or more of the eleven apertures of the first level and forms at least part of the fifth penny size aperture and the sixth penny size aperture.

15. A device for holding coins, the device comprising:
a rectangular structure including:
a first level, the first level including:
one or more finger gaps,
eleven apertures including:

a first penny size aperture, a second penny size aperture, a third penny size aperture, a fourth penny size aperture, a first dime size aperture, a second dime size aperture, a third dime size aperture, a fourth dime size aperture, a first nickel size aperture, a first quarter size aperture, and a second quarter size aperture arranged clockwise and then inward around the first level in the order of, from a top left corner of the first level:

the first dime size aperture, the first nickel size aperture, the second dime size aperture, the first penny size aperture, the first quarter size aperture, the third dime size aperture, the fourth dime size aperture, the second quarter size aperture, and the second penny size aperture, with the third penny size aperture located between the first dime size aperture and fourth dime size aperture and the fourth penny size aperture located between the second dime size aperture and third dime size aperture; and a second level, the second level including:

two apertures, surrounded by the eleven apertures of the first level including:

a fifth penny size aperture located between the first dime size aperture and fourth dime size aperture and a sixth penny size aperture located between the second dime size aperture and third dime size aperture; and a flange that partially overlaps one or more of the eleven apertures of the first level and forms at least part of the fifth penny size aperture and the sixth penny size aperture.

* * * * *